US006157345A

United States Patent [19]

Hockett et al.

[11] Patent Number: 6,157,345

[45] Date of Patent: Dec. 5, 2000

[54] ANTENNA ASSEMBLY AND METHOD OF INSTALLING AN ANTENNA

[75] Inventors: Mark E. Hockett, Santa Cruz; Steven J. Riede, Long Beach, both of Calif.

[73] Assignee: Magnadyne Corporation, Compton, Calif.

[21] Appl. No.: 09/404,898

[22] Filed: Sep. 24, 1999

[51] Int. Cl.[7] ..... H01Q 1/32

[52] U.S. Cl. ..... 343/715

[58] Field of Search ..... 343/711, 715, 343/713; H01Q 1/32

[56] References Cited

U.S. PATENT DOCUMENTS

| | | | |
|---|---|---|---|
| 2,212,253 | 8/1940 | Stief | 343/715 |
| 2,850,305 | 9/1958 | Chadowski et al. | 343/715 |
| 3,453,618 | 7/1969 | Ukmar et al. | 343/715 |
| 4,058,811 | 11/1977 | Gauss et al. | 343/715 |
| 4,066,324 | 1/1978 | Stephens | 343/715 |
| 4,086,596 | 4/1978 | Gauss et al. | 343/715 |
| 4,115,779 | 9/1978 | Dantzler et al. | 343/715 |
| 4,184,162 | 1/1980 | Grashow | 343/715 |
| 5,349,361 | 9/1994 | Egashira et al. | 343/715 |

*Primary Examiner*—Don Wong
*Assistant Examiner*—Hoang Nguyen
*Attorney, Agent, or Firm*—Brooks & Kushman P.C.

[57] ABSTRACT

An antenna for a vehicle including an antenna mast, a mast base and subsurface base that are assembled by means of a fastener that connects the mast base and subsurface base to a body panel of a vehicle. The mast base is a solid member that does not include any openings or conjoint members that could provide a leak path through the mast base. A fastener extends through a hole in the subsurface base and is retained as a subassembly with the subsurface base by means of a retainer clip. The subsurface base includes a coaxial cable receptacle and provides a ground for the coaxial cable shield and conductor for a center conductor. The ground may be provided by a serrated washer and serrations that may be driven into the body panel when the fastener is secured. The center conductor is engaged by the fastener to conduct radio signals from the mast, through the mast base, to the fastener, and to the center conductor of the coaxial cable. A plastic gasket as provided on the mast base to seal and insulate the mast base from the vehicle body.

21 Claims, 2 Drawing Sheets

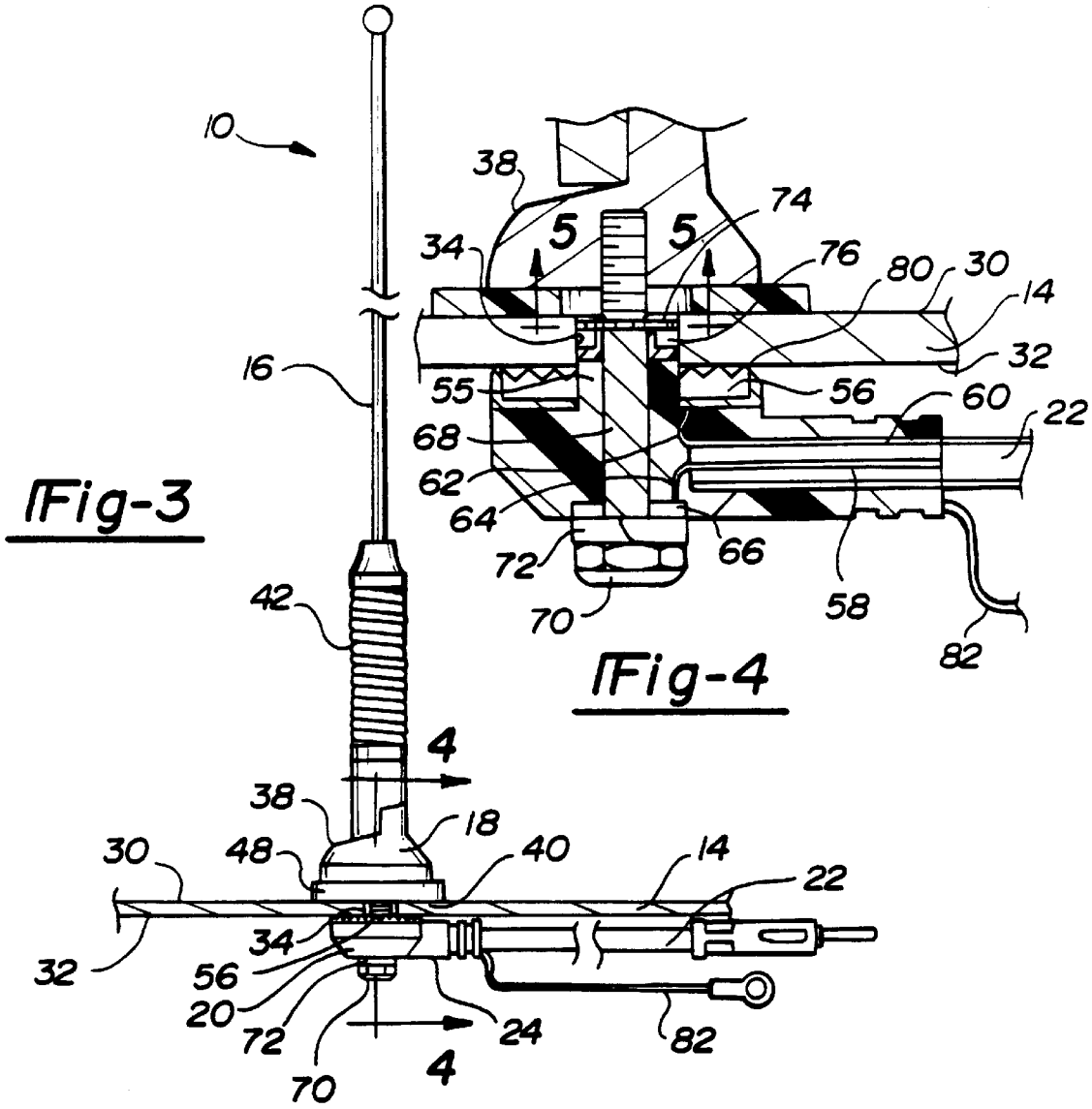
Fig-3
Fig-4
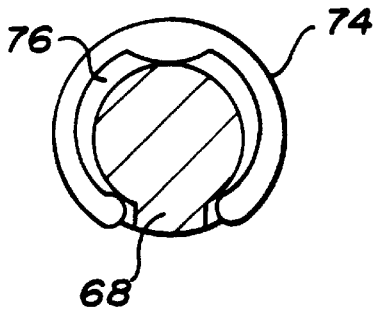
Fig-5

ANTENNA ASSEMBLY AND METHOD OF INSTALLING AN ANTENNA

TECHNICAL FIELD

The present invention relates to an antenna assembly for a vehicle and to a method of assembling an antenna assembly to the vehicle.

BACKGROUND ART

The vehicle radios including AM/FM and citizen band radios generally require the installation of an external antenna on a roof, door or fender. In many prior art antenna assemblies, a water leakage path is created wherein water running down the mast may eventually pass through the antenna mount to the inside surface of a body panel to which the antenna assembly is attached. If water reaches the inside of a body panel moisture may accumulate and lead to rust and corrosion of the body panel.

Antenna assemblies normally connected to a radio by a coaxial cable that includes a center conductor that is surrounded by a tubular shield. Generally, the tubular shield is connected to ground on the vehicle while the center conductor is connected directly to the mast of the antenna below the surface of the body panel to which the antenna assembly is to be attached. The shield is normally connected to the vehicle ground while the center connector is connected through an impedance coil to the mast.

Another problem presented by prior art antenna assembly designs is that they are difficult to install. For instance, on a roof mount truck antenna, one or two persons are generally required to hold upper and lower halves of the antenna mount to align and secure the two halves of the antenna mount together. In original equipment installations and after market installations, assembly of the antenna to a vehicle body panel is complicated by the need to, for example, hold the top half of the antenna mount with a wrench while using another wrench to secure the lower half of the antenna assembly to the upper half.

The lower antenna assembly may also require connection of electrical contacts to the vehicle and antenna mast and to a coaxial cable. In multi-part antenna assemblies it may be difficult to hold all of the parts of the lower antenna assembly together while trying to secure it to the upper antenna assembly.

Another problem with prior art antenna assemblies is that the antenna assemblies are normally designed to be assembled together over a body panel having a limited range of thickness. For example, the original equipment antennas may be installed on the roof of a truck prior to assembly of the head liner and may require securing the antenna assembly through one or two thicknesses of sheet metal. If an antenna is added to the truck roof as a retrofit, it may be necessary to secure the antenna assembly through both the roof and head liner greatly increasing the thickness of the body panel to which the antenna assembly must be secured. Previously, an entirely different antenna assembly hardware is provided for OEM and after market installations.

These and other problems and disadvantages associated with the prior art are addressed by this invention.

DISCLOSURE OF INVENTION

According to one aspect of the present invention, an antenna is provided for a vehicle that is mounted on an antenna supporting surface of a body panel. The body panel has a hole extending through it from the antenna supporting surface to the lower surface of the body panel. The antenna includes a mast that is secured to a mast base that is preferably formed as a solid body having an upper surface and a bottom surface. The mast base is secured to the antenna supporting surface of the body panel. No opening or partition line extends from the upper surface to the bottom surface of the mast base. As an improvement over prior art embodiments, this solid mast base design prevents water or moisture from flowing or creeping along the mast or other joint through the hole provided in the body panel. Such a nonjointed mast base design prevents any rust or corrosion at or below the body panel lower surface.

In addition, the solid mast base provides a robust connection for electrical conductivity to the antenna mast. This is an improvement over prior art embodiments where electrical conductivity to the mast is provided by a soldered joint that is susceptible to corrosion and failure. The mast base has a fastener receptacle in its bottom surface. A subsurface base is assembled to the lower surface of the body panel and defines an opening that is aligned with a threaded hole from the bottom surface of the mast base. A fastener having a head and an elongated shaft is received in the opening in the subsurface base, the hole extending through the body panel and into the fastener receptacle in the bottom surface of the mast base. The fastener is secured to the fastener receptacle in the bottom surface of the mast base with the center contact conductively connected to the fastener.

According to another aspect of the present invention, the fastener is rotatable within the opening in the subsurface base and may be secured without requiring rotation of the subsurface base with the fastener. The subsurface base and fastener are preferably preassembled as a unitary structure with a retainer clip prior to being assembled to the body panel and the mast base.

According to an additional aspect of the present invention relating to the coaxial cable receptacle connection to the vehicle and antenna, the ground contact may be a serrated annular metallic member that is provided on a surface of the subsurface base that is held in contact with the lower surface of the body panel. Alternatively, the ground contact may be a cable having a connector that is fastened to a grounding point on the vehicle. The center contact is preferably an annular metallic member that is contacted by the head or other part of the fastener.

According to another additional aspect of the present invention, a gasket is provided between the lower surface of the mast base and the antenna supporting surface of the vehicle body panel. The gasket provides a seal and electrical insulation between the mast base and body panel, and may be adhesively bonded to the bottom surface of the mast base.

According to yet another aspect of the invention, the fastener may be interchanged with a fastener of different length depending upon the distance between the antenna's supporting surface and the lower surface of the body panel. The fastener is preferably a threaded fastener that is received in a threaded hole at the bottom surface of the mast base.

The invention also provides a method of installing an antenna assembly on a mounting surface of a body panel of the vehicle having an inner surface and a hole extending through the body panel. The antenna assembly includes a mast, a mast base including a fastener receptacle, a subsurface base including a coaxial cable receptacle, a fastener and a retainer clip. The method includes the steps of assembling the mast to the mast base. The fastener is preassembled to the subsurface base with the retainer clip. The mast base including the fastener receptacle is placed over the hole extending through the body panel. The fastener is then inserted through the hole extending through the body panel and secured to the fastener receptacle.

According to another aspect of the invention, the antenna assembly includes a sealing and electrically insulating gasket and the method further comprises adhesively bonding the gasket to the mast base before the mast base is placed over the hole extending through the body panel.

According to the method of the present invention, the subsurface base includes an annular metallic member having serrations. The annular metallic member is provided on a surface of the subsurface base that is held in contact with the lower surface of the body panel. The serrated annular metallic member is conductively connected to a shielding connector of the coaxial cable receptacle. The method comprises grounding the assembly to the vehicle by forcing the serrations into the body panel as the fastener is secured to the fastener receptacle.

The fastener is preferably a threaded carriage bolt and the fastener receptacle is preferably a threaded hole at the bottom surface of the mast base. The coaxial cable receptacle extends perpendicularly relative to the fastener from the subsurface base and the method further comprises tightening the carriage bolt into the threaded hole while preventing the subsurface base from rotating.

The method of the invention features a subsurface base including an annular metallic member that is conductively connected to a center contact of the coaxial cable receptacle that is contacted by the fastener. The method further comprising conductively connecting the center contact of the coaxial cable receptacle to the annular metallic member, the fastener, the mast base and the mast as the threaded fastener is secured to the mast base.

According to another aspect of the method of the present invention the fastener has a head and an annular metallic member is disposed around an opening defined by the subsurface base through which the fastener is received. The method further comprises establishing the conductive connection between the fastener and the annular metallic member by forcing the head of the fastener against the annular metallic member.

Other aspects and advantages of the present invention will be apparent upon review of the attached drawings and in light of the following detailed description of the invention.

BRIEF DESCRIPTION OF DRAWINGS

FIG. 3 is a side elevation view of an antenna assembly made according to the present invention.

FIG. 4 is a fragmentary cross-section view taken along the line 4—4 in FIG. 3 of the subsurface base and mast base of the antenna assembly of the present invention.

FIG. 5 is a cross-section view taken along the lines 5—5 in FIG. 4.

BEST MODE FOR CARRYING OUT THE INVENTION

Figure 1:
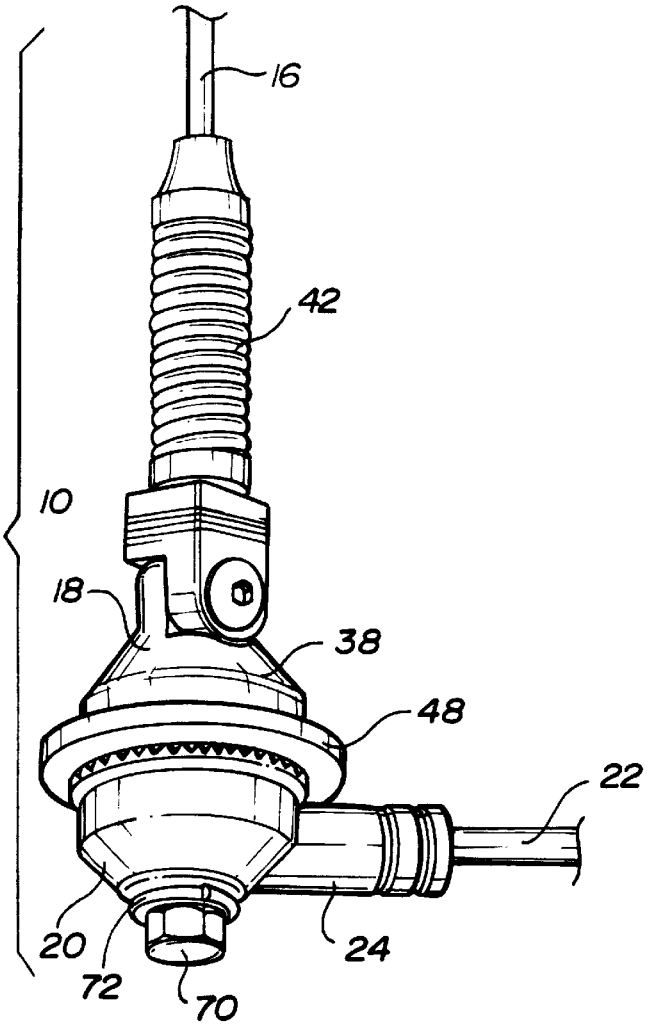
FIG. 1 is a perspective view of an antenna assembly made according to the present invention.
Figure 2:
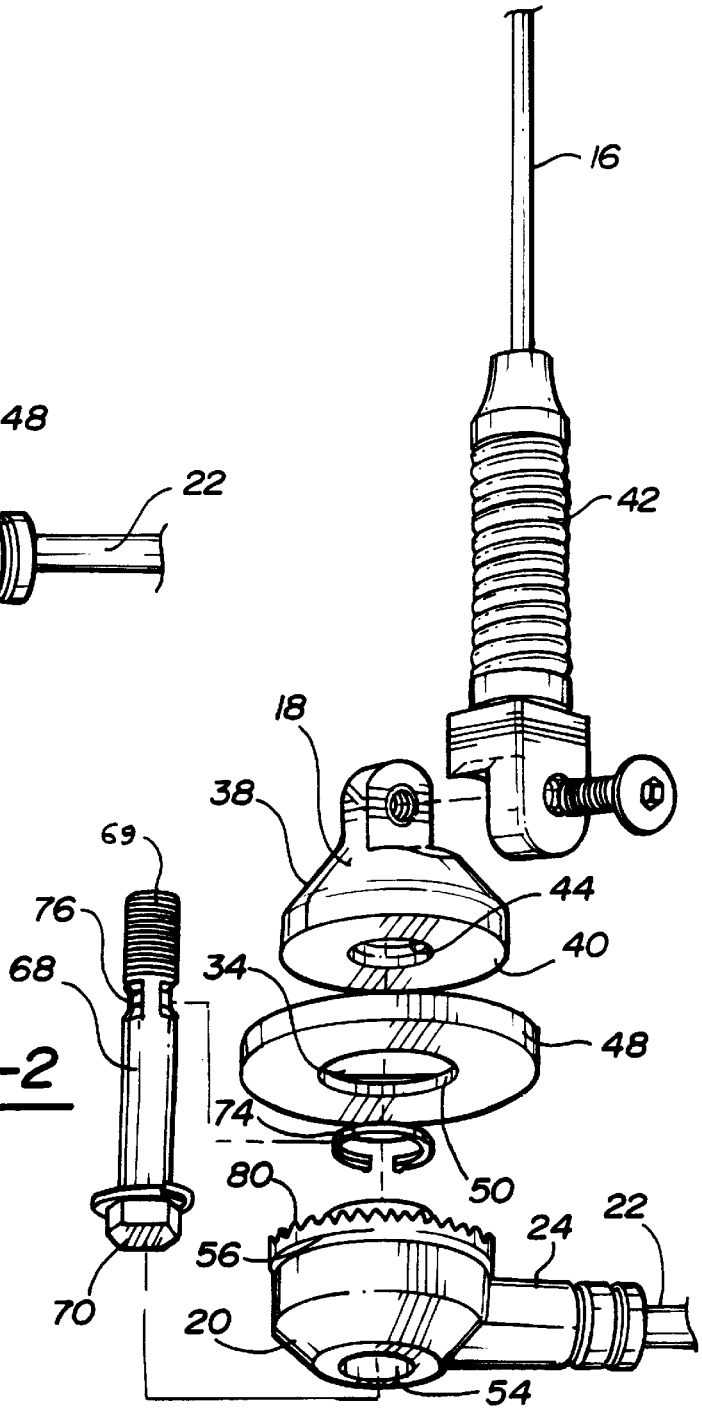
FIG. 2 is an exploded perspective view of an antenna assembly made according to the present invention.

Referring now to FIGS. 1, 2 and 3 an antenna assembly 10 made in accordance with the present invention is shown. In FIG. 3, the antenna assembly 10 is shown as it is secured to a body panel 14 of a vehicle. The antenna assembly 10 includes a mast 16 that is secured to a mast base 18. Mast base 18 is preferably a die-cast metal member formed as a solid body. A subsurface base 20 is provided for attachment to the body panel 14. Subsurface base 20 is connected to a coaxial cable 22 by means of an integrally formed coaxial cable receptacle 24. The body panel 14 defines an antenna supporting surface 30 and a lower surface 32. A hole 34 is formed in the body panel 14 to allow the subsurface base 20 and mast base 18 to be connected to each other and to provide a conduction path for radio signals received by the mast 16 to be transmitted to the coaxial cable 22.

The mast base 18 has an upper surface 38 and a bottom surface 40. The mast base is preferably a solid cast member and does not include any openings or joint planes extending from the upper surface 38 through to the bottom surface 40. This solid mast base design prevents water or moisture from flowing or seeping along the mast 16 through the hole 34 provided in the body panel 14. The preclusion of moisture below the body panel 14 inhibits rust or corrosion. The mast base 18 provides a robust connection for electrical conductivity to the mast 16. The mast base 18. It should be understood that the spring mount 42 could be eliminated in which case the mast 16 would be secured directly to the mast base 18.

A threaded hole 44, or fastener receptacle, is provided in the bottom surface 40 of the mast base 18.

A gasket 48 comprising annular elastomeric member having an opening 50 is secured to the bottom surface 40 of the mast base 18. The gasket 48 provides insulation and also functions as a water seal. The gasket 48 is preferably bonded to the bottom surface 40 of the mast base 18.

The subsurface base 20 has an opening 54 extending through the center of subsurface base 20. The subsurface base 20 is preferably formed from molded plastic and has an annular protrusion 55 on its upper surface that is sized to be received in the opening 34. A serrated annular metallic member 56 is assembled to the annular protrusion 55 on the upper surface of the subsurface base 20. The serrated annular metallic member 56 can be used to ground the coaxial cable 22 as will be described in more detail below.

Referring now to FIG. 4, the subsurface base 20 is shown in cross-section to illustrate the grounding and conducting members. The coaxial cable 22 includes a center conductor 58 and a shielding conductor 60. The shielding conductor 60 is connected by a ground contact wire 62 to the serrated annular metallic member 56. A center contact wire 64 is connected to the center conductor 58 and a center contact 66 that is molded into the bottom of the subsurface base 20. The center contact 66 is preferably an annular metallic member.

A fastener 68, for example, a carriage bolt, has a head 70 at one end and is received in the opening 54 in the subsurface base 20. The head 70 of the fastener 68 when tightened contacts the center contact 66 establishing a conductive path from the center conductor 58 of the coaxial cable 22 to the fastener 68. The lock washer 72 is provided on the fastener 68 to lock the fastener 68 in place. The fastener 68 includes a threaded end 69 opposite the head 70. The threaded end 69 of the fastener 68 is received in the threaded hole 44. If another type of fastener receptacle is provided on the bottom surface 40 of the mast base 18, a corresponding alternate fastener mechanism could be provided instead of the threads on the end of the fastener 68. For example, a bayonet mount, spring mount or other well known mounting mechanism could be used.

Referring now to FIGS. 2, 4 and 5, a retainer clip 74 is received in a groove 76 formed intermediate the length of the fastener 68. The retainer clip is a C-shaped spring clip preferably formed of a rigid and resilient non-metallic material such as fiber board or other non-conductive material. When the fastener 68 is inserted into the opening 54 in the subsurface base 20, the retainer clip 74 can be pressed into the annular groove 76 to trap the fastener 68 within the opening 54 in the subsurface base 20.

The design of the antenna assembly of the present invention is flexible in that it can be modified to adapt to different thicknesses of body panels 14. For example, a single thickness of sheet metal could comprise a body panel as would be normally encountered when a vehicle is initially assembled. However, many times antennas are added as after market equipment and may be installed over a body panel 14 including an outer body panel and an inner body panel or a roof liner. In this case it may be necessary to accommodate body panel thicknesses of ½" or more. Either application can be accommodated by the antenna assembly of the present invention by merely substituting proper length fastener 68 to accommodate the variations in the thickness of the body panel 14.

Referring now to FIGS. 3 and 4, the serrated annular metallic member 56 includes a plurality of serrations 80 that are relatively sharp to facilitate their penetration into the lower surface 32 of the body panel 14 of the vehicle. This provides a convenient way to ground the shielding conductor 60 of the coaxial cable 22 when the body panel 14 is a metallic grounded part of the vehicle. If the body panel 14 is not formed of metal or an insulative member is provided on the lower surface 32, a ground cable 82 may be connected to the ground contact wire 62 that grounds the shielding conductor 60 of the coaxial cable 22.

The method of installing the antenna of the present invention is described below.

Mast 16 is attached to mast base 18 and gasket 48 is assembled or adhesively bonded to the bottom of the mast base 18.

Insert the lock washer 72 onto the shank of fastener 68. Insert the fastener 68 fully into the opening 54 that extends through the center of subsurface base 20. Insert the retainer clip 74 into the groove 76 of fastener 68 above the protrusion 55 to retain the fastener 68 in the subsurface base 20.

Create a hole 34 through the vehicle body panel 14 of sufficient diameter to receive the protrusion 55 and the fastener 68.

Align subsurface base 20 beneath the body panel 14 such that the fastener 68 is concentric with the hole 34. Insert the fastener 68 of subsurface base 20 from the lower surface of the body panel 32 outward until the serrated annular metallic member 56 contacts the lower surface of the body panel 32.

Gasket 48 of the mast base 18 is positioned against the exterior surface of the panel of the body panel 14 and concentric with fastener 68.

Fastener 68 is threaded into the threaded hole 44 of the mast base 18. Coaxial cable receptacle 24 and coaxial cable 22 are placed in position for permanent installment.

The antenna assembly 10 is secured to the body panel 14 by turning the fastener head 70 with a wrench until the mast base 18 and subsurface base 20 are securely fastened to the body panel 14.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. An antenna for a vehicle having a body panel defining an antenna supporting surface and a lower surface and having a hole extending through the body panel from the antenna supporting surface to the lower surface, the antenna comprising:

a mast;

a mast base formed as a solid body having an upper surface and a bottom surface, the mast base being secured to the antenna supporting surface of the body panel, the mast being secured to the upper surface of the mast base, the mast base having a fastener receptacle on the bottom surface;

a subsurface base assembled to the lower surface of the body panel and defining an opening that is aligned with the fastener receptacle in the bottom surface of the mast base; and a conductive fastener received in the subsurface base, extending through the body panel, and conductively fastened to the mast base, wherein the fastener is rotatable within the opening in the subsurface base and being secured without requiring that the subsurface base rotate with the fastener.

2. The antenna of claim 1 further comprising a gasket for providing a seal and electrical insulation between the mast base and the antenna supporting surface of the vehicle body panel.

3. An antenna for a vehicle having a body panel defining an antenna supporting surface and a lower surface and having a hole extending through the body panel from the antenna supporting surface to the lower surface, the antenna comprising:

a mast;

a mast base formed as a solid body having an upper surface and a bottom surface, the mast base being secured to the antenna supporting surface of the body panel, the mast being secured to the upper surface of the mast base, the mast base having a fastener receptacle formed on through the bottom surface;

a subsurface base assembled to the lower surface of the body panel and defining an opening that is aligned with the fastener receptacle in the bottom surface of the mast base;

a receptacle for a coaxial cable on the subsurface base;

a coaxial cable having a center wire and a shielding conductor;

a ground contact connected to the shielding conductor of the coaxial cable;

a center contact connected to the center wire of the coaxial cable;

a conductive fastener received in the subsurface base, extending through the body panel, and conductively fastened to the mast base;

the fastener being secured to the fastener receptacle in the bottom surface of the mast base with the center contact being conductively connected to the fastener, wherein the fastener is rotatable within the opening in the subsurface base and being secured without requiring that the subsurface base rotate with the fastener.

4. The antenna of claim 3 wherein the subsurface base and the fastener are preassembled as a unitary structure prior to being assembled to the body panel and the mast base.

5. The antenna of claim 3 wherein the ground contact is a serrated annular metallic member provided on a surface of the subsurface base that is held in contact with the lower surface of the body panel.

6. The antenna of claim 3 wherein the ground contact is a cable having a connector that is fastened to a grounding point on the vehicle.

7. The antenna of claim 3 wherein the center contact is an annular metallic member that is contacted by the fastener.

8. The antenna of claim 7 wherein the annular metallic member is contacted by the head of the fastener.

9. The antenna of claim 3 wherein the mast includes a first mounting element and the mast base includes a second mounting element that may be secured to the first mounting element in a range of positions to allow the mast to be positioned in a desired angular orientation relative to the mounting surface.

10. The antenna of claim 3 further comprising a gasket for providing a seal and electrical insulation between the lower surface of the mast base and the antenna supporting surface of the vehicle body panel.

11. The antenna of claim 10 wherein the gasket is adhesively bonded to the bottom surface of the mast base.

12. The antenna of claim 3 wherein the fastener may be interchanged with a fastener of different length depending upon the distance between the antenna supporting surface and the lower surface of the body panel.

13. An antenna for a vehicle having a body panel defining an antenna supporting surface and a lower surface and having a hole extending through the body panel from the antenna supporting surface to the lower surface, the antenna comprising:

a mast;

a mast base formed as a solid body having an upper surface and a bottom surface, the mast base being secured to the antenna supporting surface of the body panel, the mast being secured to the upper surface of the mast base, the mast base having a fastener receptacle formed on through the bottom surface;

a subsurface base assembled to the lower surface of the body panel and defining an opening that is aligned with the fastener receptacle in the bottom surface of the mast base;

a receptacle for a coaxial cable on the subsurface base;

a coaxial cable having a center wire and a shielding conductor;

a ground contact connected to the shielding conductor of the coaxial cable;

a center contact connected to the center wire of the coaxial cable;

a conductive fastener received in the subsurface base, extending through the body panel, and conductively fastened to the mast base, the fastener being secured to the fastener receptacle in the bottom surface of the mast base with the center contact being conductively connected to the fastener, wherein the subsurface base and the fastener are preassembled as a unitary structure prior to being assembled to the body panel and the mast base, the unitary structure being maintained by a retainer clip inserted into a groove in the elongated shaft of the fastener above the ground contact such that separation of the fastener from the subsurface is prevented by the head of the fastener and the retainer clip.

14. An antenna for a vehicle having a body panel defining an antenna supporting surface and a lower surface and having a hole extending through the body panel from the antenna supporting surface to the lower surface, the antenna comprising:

a mast;

a mast base formed as a solid body having an upper surface and a bottom surface without an opening extending from the upper surface to the bottom surface, the mast base being secured to the antenna supporting surface of the body panel, the mast being secured to the upper surface of the mast base, the mast base having a threaded hole extending through the bottom surface;

a subsurface base assembled to the lower surface of the body panel and defining an opening that is aligned with the threaded hole in the bottom surface of the mast base;

a receptacle for a coaxial cable on the subsurface base;

a threaded fastener having a head and an elongated shaft and being received in the opening in the subsurface base, the hole extending through the body panel, and in the threaded hole extending through the bottom surface;

a clip secured to the fastener to retain the fastener in the opening in the subsurface base prior to assembly to the mast base;

the fastener being secured to the threaded hole in the bottom surface of the mast base, wherein the fastener is rotatable within the opening in the subsurface base and being secured without requiring that the subsurface base rotate with the fastener.

15. The antenna of claim 14 wherein the subsurface base and the fastener are preassembled as a unitary structure prior to being assembled to the body panel and the mast base.

16. The antenna of claim 14 wherein the fastener may be interchanged with a fastener of different length depending upon the distance between the antenna supporting surface and the lower surface of the body panel.

17. A method of installing an antenna assembly on an antenna mounting surface of a body panel of a vehicle, the body panel having an inner surface and having a hole extending through the body panel, the antenna assembly including a mast, a mast base including a fastener receptacle, a subsurface base including a coaxial cable receptacle, a fastener and a retainer clip, wherein the fastener is a threaded carriage bolt and the fastener receptacle is a threaded hole in a bottom surface of the mast base and wherein the coaxial cable receptacle extends perpendicularly relative to the fastener from the subsurface base, the method comprising:

assembling the mast to the mast base;

assembling the fastener to the subsurface base with the retainer clip;

placing the mast base with the fastener receptacle located over the hole extending through the body panel;

inserting the fastener through the hole extending through the body panel and the method further comprising tightening the carriage bolt into the threaded hole of the fastener receptacle while preventing the subsurface base from rotating, the fastener being rotatable within the opening in the subsurface base and being secured without requiring that the subsurface base rotate with the fastener.

18. The method of installing an antenna of claim 17 wherein the antenna assembly further includes a sealing and electrically insulating gasket, wherein the method further comprises adhesively bonding the gasket to the mast base before the mast base is placed over the hole extending through the body panel.

19. The method of installing an antenna of claim 17 wherein the subsurface base includes an annular metallic member having serrations, the annular metallic member being provided on a surface of the subsurface base that is held in contact with the lower surface of the body panel, the serrated annular metallic member being conductively connected to a shielding conductor of the coaxial cable receptacle, the method further comprising grounding the assembly to the vehicle by forcing the serrations into the body panel as the fastener is secured to the fastener receptacle.

20. The method of installing an antenna of claim 17 wherein the subsurface base includes an annular metallic member that is conductively connected to a center contact of the coaxial cable receptacle and contacted by the fastener, the method further comprising conductively connecting the center contact of the coaxial cable receptacle to the annular metallic member, the fastener, the mast base and the mast as the fastener is secured to the mast base.

21. The method of installing an antenna of claim 17 wherein the fastener has a head and the annular metallic member is disposed around an opening defined by the subsurface base through which the fastener is received, the method further comprising establishing the conductive connection between the fastener and the annular metallic member by forcing the head of the fastener against the annular metallic member.

* * * * *